US011639792B2

(12) United States Patent
Gullapalli et al.

(10) Patent No.: US 11,639,792 B2
(45) Date of Patent: May 2, 2023

(54) SINGLE-PIECE REFRACTORY FOR A WATER HEATING ASSEMBLY

(71) Applicant: Rheem Manufacturing Company, Atlanta, GA (US)

(72) Inventors: Satya Kiran Gullapalli, Camarillo, CA (US); Timothy Shellenberger, Tyronne, GA (US); Ryan Valencia, Oxnard, CA (US); Juan Garcia, Oxnard, CA (US)

(73) Assignee: Rheem Manufacturing Company, Atlanta, GA (US)

( * ) Notice: Subject to any disclaimer, the term of this patent is extended or adjusted under 35 U.S.C. 154(b) by 387 days.

(21) Appl. No.: 16/910,331

(22) Filed: Jun. 24, 2020

(65) Prior Publication Data

US 2021/0404650 A1 Dec. 30, 2021

(51) Int. Cl.

| | |
|---|---|
| ***F23C 5/02*** | (2006.01) |
| ***F23D 14/36*** | (2006.01) |
| ***F23D 14/02*** | (2006.01) |
| ***F23D 14/72*** | (2006.01) |
| *F24H 1/14* | (2022.01) |

(52) U.S. Cl.

CPC ..... *F23C 5/02* (2013.01); *F23D 14/02* (2013.01); *F23D 14/36* (2013.01); *F23D 14/725* (2013.01); *F23D 2203/007* (2013.01); *F24H 1/145* (2013.01)

(58) Field of Classification Search

CPC . F23C 5/02; F23D 14/02; F23D 14/36; F23D 14/725; F23D 2203/007; F24H 1/145

USPC ..... 122/18.1

See application file for complete search history.

(56) References Cited

U.S. PATENT DOCUMENTS

| | | | | | |
|---|---|---|---|---|---|
| 3,630,175 | A * | 12/1971 | Reid, Jr. | F24H 1/145 | 122/406.1 |
| 4,125,359 | A * | 11/1978 | Lempa | F23C 5/02 | 431/348 |
| 4,901,677 | A * | 2/1990 | Demetri | F22B 21/26 | 165/102 |
| 5,109,807 | A * | 5/1992 | Sarkisian | F24H 1/43 | 237/56 |
| 6,997,701 | B2 * | 2/2006 | Volkert | F23D 14/16 | 431/346 |
| 2011/0146450 | A1 * | 6/2011 | Docquier | F23D 14/32 | 431/12 |

(Continued)

*Primary Examiner* — Avinash A Savani

(74) *Attorney, Agent, or Firm* — Eversheds Sutherland (US) LLP

(57) ABSTRACT

The disclosed technology includes a water heater system having a blower, an igniter, a burner, a heat exchanger, and a refractory configured to attach to the burner and the heat exchanger. The refractory can include a unitary ceramic housing having a top and a plurality of sidewalls and be configured to retain heat from combustion gases. The top can have a burner aperture configured to receive at least a portion of the burner and the plurality of sidewalls can form a cavity configured to receive at least a portion of the heat exchanger. One or more of the sidewalls can additionally have a protrusion extending laterally along an inside surface of the sidewall that is configured to contact the heat exchanger to form a seal between the heat exchanger and the refractory. A sealing material can substantially create a seal between the refractory and the heat exchanger.

20 Claims, 4 Drawing Sheets

(56) References Cited

U.S. PATENT DOCUMENTS

2014/0000569 A1* 1/2014 Eilemann ..... F28D 7/1692
123/542

* cited by examiner

SINGLE-PIECE REFRACTORY FOR A WATER HEATING ASSEMBLY

FIELD OF TECHNOLOGY

The present disclosure relates generally to gas-fired heating applications utilizing a combustion chamber and a heat exchanger, and, more particularly, to refractories used in water heating assemblies.

BACKGROUND

Refractories are commonly used to retain heat within a combustion chamber, furnace, kiln, incinerator, reactor, crucible, or other high-heat application. This is because refractories are made of material resistant to decomposition under heat or pressure and serve as a thermal barrier between a heat source and the structure containing the heat source. Because refractories can act as a thermal barrier, the refractories can help retain heat in the system and protect other components from being damaged by the heat.

In some water heating systems, refractories can be used to contain the heat produced by a burner assembly so the heat can be better directed toward a heat exchanger to heat water. For example, gas-fired water heaters used in residential or commercial applications (e.g., residential water heaters, commercial water heaters, pool heaters, etc.) can utilize refractories arranged to help retain heat within a combustion chamber and heat the water. Existing water heating systems, however, typically employ multi-piece refractories, which can require some amount of labor cost associated with assembling the refractory itself during assembly of the overall heating system. A multi-piece refractory can result in unwanted heat loss and thermal inefficiencies in the water heating system because gaps can exist between adjacent pieces of the refractory. Gaps between adjacent pieces of the refractory can also lead to unsafe operating conditions because heat escaping the combustion chamber can damage nearby components outside of the combustion chamber. As another disadvantage, gaps between the refractory and the heat exchanger in the combustion chamber can allow heat to escape past the heat exchanger without going through the heat exchanger tubes, resulting in additional thermal inefficiency.

What is needed, therefore, is a refractory designed for simple and cost-effective assembly and capable of preventing heat loss and/or efficiently directing heat through the heat exchanger, thereby increasing the overall thermal efficiency of the water heating system. These and other problems are addressed by the technology disclosed herein.

SUMMARY

The disclosed technology relates generally to a refractory used in a water heating system. The disclosed technology can include a water heater system having a blower for moving a mixture of air and fuel, an igniter to ignite the mixture of air and fuel, a burner to produce a controlled flame to create heat, and a heat exchanger to facilitate heat transfer to a fluid. The burner and heat exchanger can be mounted to a refractory that is configured to retain the heat.

The refractory can include a unitary ceramic housing having a top with a burner aperture extending through it. The burner aperture can be configured to receive a portion of the burner. The refractory can also have a plurality of sidewalls extending from the top to create a cavity. Each of the sidewalls can have a first end near the top and a second end near the heat exchanger. One or more of the sidewalls can have a protrusion extending laterally along an inside surface of the one or more sidewalls that is configured to contact the heat exchanger and form a seal between the heat exchanger and the refractory.

The seal can be created by the protrusion deforming when fins of the heat exchanger contacts the protrusion. The fins can cut into the protrusion to form the seal.

The burner and the igniter of the water heating system can be a single unit or they can be separate units. In cases where the burner and the igniter are separate units, the refractory top can have an igniter aperture configured to receive the igniter. The igniter aperture can have an inner end that is proximate the inner surface of the refractory top and an outer end that is proximate the outer surface of the refractory top, and the inner end can have an area that is greater than an area of the outer end The igniter aperture can have a generally frustoconical shape. Alternatively, the igniter aperture can include two or more portions. For example, the igniter aperture can include a first portion having a generally cylindrical shape and a second portion that has a generally frustoconical shape. The first portion can be proximate the outer surface of the refractory top, and the second portion can be proximate the inside surface of the refractory top.

The burner aperture can have inner end that is proximate the inner surface and an outer end that is proximate the outer surface of the refractory top, and the inner end can have an area that is greater than an area of the outer end.

The sidewalls can have a sealing material affixed to a bottom surface of the plurality of sidewalls that is configured to form a seal between the plurality of sidewalls and the heat exchanger.

The sidewalls can include two short sidewalls and two long sidewalls extending outward from the refractory top to form a cavity. The two long sidewalls can include the protrusion, and the two short sidewalls can contact the heat exchanger near a header of the heat exchanger without a protrusion.

The disclosed technology can also include a unitary housing for a water heating assembly configured to retain heat produced by a burner as the heat is directed toward a heat exchanger. The unitary housing can have a refractory top that has a burner aperture extending through it and configured to receive at least a portion of a burner.

The unitary housing can include a plurality of sidewalls forming a central cavity. Each of the sidewalls can have a first end extending from the refractory top and a second end configured to contact a heat exchanger. One or more of the sidewalls can include a protrusion extending laterally along an inside surface of the one or more sidewalls. The protrusion can contact fins on the heat exchanger to create a seal between the heat exchanger and the refractory.

The refractory top can include an igniter aperture extending therethrough, and the igniter aperture can be configured to receive an igniter. The igniter aperture can have an inner end that is proximate the inner surface and an outer end that is proximate the outer surface of the refractory top, and the inner end can have an area that is greater than an area of the outer end. The igniter aperture can have a generally frustoconical shape. Alternatively, the igniter aperture can include two or more portions. For example, the igniter aperture can include a first portion having a generally cylindrical shape and a second portion that has a generally frustoconical shape. The first portion can be proximate the outer surface of the refractory top, and the second portion can be proximate the inside surface of the refractory top. The unitary housing can include a burner aperture that can have an inner end that is proximate the inner surface and an outer end that is proximate the outer surface of the refractory top, and the inner end can have an area that is greater than an area of the outer end.

The protrusion can be configured to form a seal between the heat exchanger and the refractory by deforming when the fins of the heat exchanger contact the protrusion. The fins can be configured to cut into the protrusion to form the seal. Alternatively, or in addition, the protrusion can include a sealing material configured to form the seal between the heat exchanger and the refractory.

The unitary housing can include a sealing material affixed to a bottom surface of the sidewalls. The sealing material can be configured to form a seal between the sidewalls and the heat exchanger when the sidewalls contact the heat exchanger. The sidewalls can include two short sidewalls and two long sidewalls extending outward from the refractory top to form a central cavity. The two long sidewalls can include the protrusion and the two short sidewalls can be configured to adjoin the heat exchanger nearest a header of the heat exchanger.

Additional features, functionalities, and applications of the disclosed technology are discussed herein in more detail.

BRIEF DESCRIPTION OF THE DRAWINGS

The accompanying drawings, which are incorporated in and constitute a part of this specification, illustrate multiple examples of the presently disclosed subject matter and serve to explain the principles of the presently disclosed subject matter. The drawings are not intended to limit the scope of the presently disclosed subject matter in any manner.

DETAILED DESCRIPTION

Figure 1:
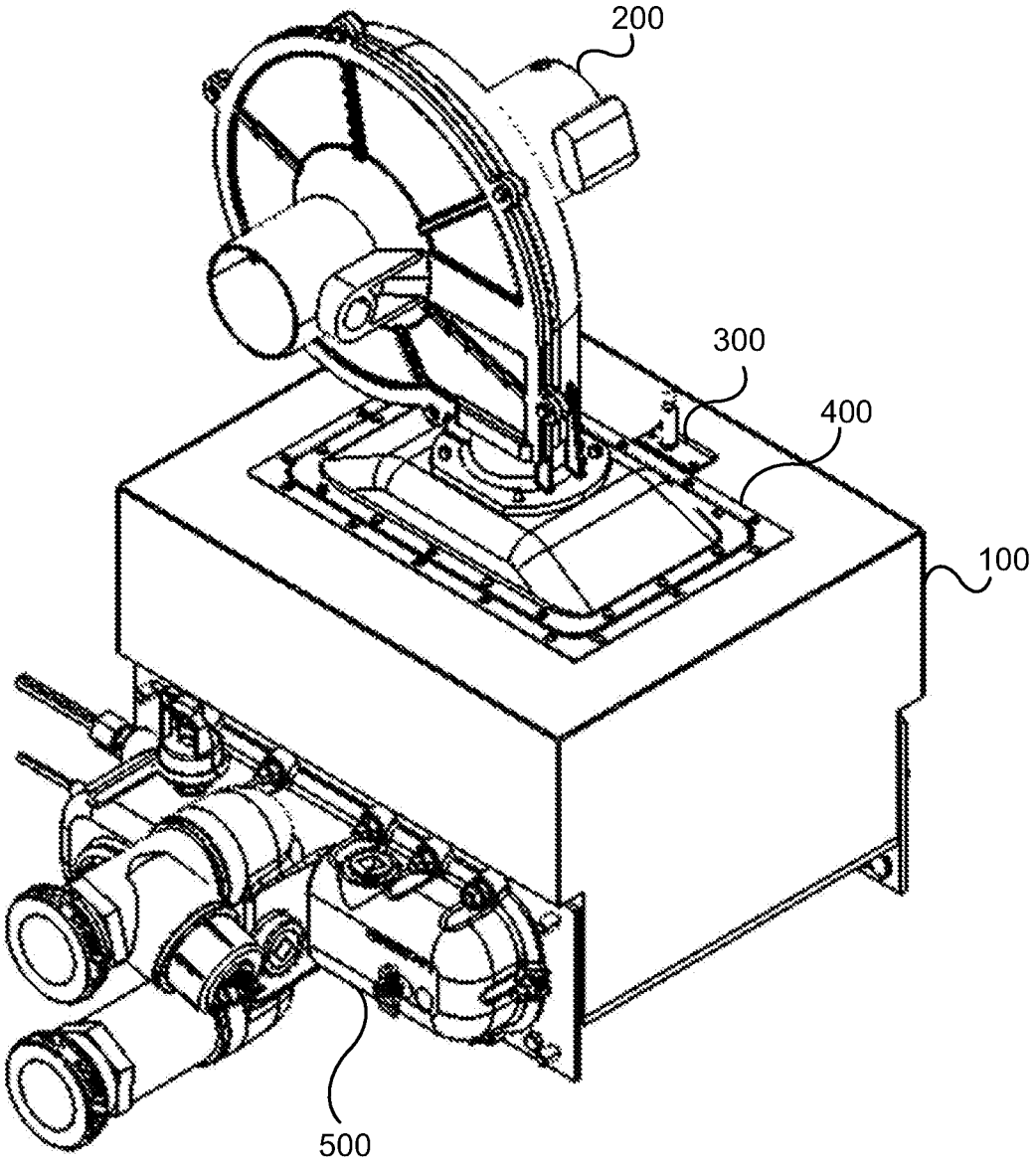
FIG. 1 illustrates a top isometric view of an example water heating system, in accordance with the disclosed technology.

The disclosed technology relates generally to refractories used in water heating assemblies. The disclosed technology, for example, can include a refractory made from a single piece of heat-resistant material and can include apertures for receiving a burner assembly, an igniter assembly, and/or a heat exchanger. The refractory can also have a cavity between the burner assembly and the heat exchanger that can function as a combustion chamber. Additionally, the refractory can have a protrusion on the inside of the cavity (or on an inside surface of the refractory) positioned to interface with the heat exchanger when the heat exchanger connects with the refractory. The protrusion can create a seal between the refractory and the heat exchanger tubes (or between the refractory and fins installed on the tubes) so that heat will be directed through the heat exchanger rather than through any gaps between the refractory and the heat exchanger. The disclosed technology can be used with any gas-fired system used to heat a fluid, including residential water heaters, commercial water heaters, and pool heaters, but is not so limited.

Although certain examples of the disclosed technology are explained in detail, it is to be understood that other examples, embodiments, and implementations of the disclosed technology are contemplated. Accordingly, it is not intended that the disclosed technology is limited in its scope to the details of construction and arrangement of components set forth in the following description or illustrated in the drawings. The disclosed technology can be implemented in a variety of examples and can be practiced or carried out in various ways. In particular, the presently disclosed subject matter is described in the context of being a refractory for gas-fired water heaters. The present disclosure, however, is not so limited, and can be applicable in other contexts where heat is produced with a burner to transfer heat to a fluid through a heat exchanger. The present disclosure, for example and not limitation, can include combustion chambers, furnaces, or reactors used to heat a fluid through a heat exchanger. Such implementations and applications are contemplated within the scope of the present disclosure. Accordingly, when the present disclosure is described in the context of being a refractory for gas-fired water heaters, it will be understood that other implementations can take the place of those referred to.

It should also be noted that, as used in the specification and the appended claims, the singular forms "a," "an," and "the" include plural references unless the context clearly dictates otherwise. References to a composition containing "a" constituent is intended to include other constituents in addition to the one named.

Also, in describing the examples, terminology will be resorted to for the sake of clarity. It is intended that each term contemplates its broadest meaning as understood by those skilled in the art and includes all technical equivalents which operate in a similar manner to accomplish a similar purpose.

Herein, the use of terms such as "having," "has," "including," or "includes" are open-ended and are intended to have the same meaning as terms such as "comprising" or "comprises" and not preclude the presence of other structure, material, or acts. Similarly, though the use of terms such as "can" or "may" are intended to be open-ended and to reflect that structure, material, or acts are not necessary, the failure to use such terms is not intended to reflect that structure, material, or acts are essential. To the extent that structure, material, or acts are presently considered to be essential, they are identified as such.

The components described hereinafter as making up various elements of the disclosed technology are intended to be illustrative and not restrictive. Many suitable components that would perform the same or similar functions as the components described herein are intended to be embraced within the scope of the disclosed technology. Such other components not described herein can include, but are not limited to, for example, similar components that are developed after development of the presently disclosed subject matter.

Referring now to the drawings, in which like numerals represent like elements, examples of the present disclosure are herein described. As will be described in greater detail, the present disclosure includes a refractory for gas-fired water heaters. To provide a background of the system described in the present disclosure, certain components of a gas-fired water heating system are shown in FIG. 1.

As shown in FIG. 1, a gas-fired water heating system can include a refractory 100, a blower 200, an igniter assembly 300, a burner assembly 400, and a heat exchanger 500. The refractory 100 can form a combustion chamber for a mixture of air and fuel introduced into the refractory 100 to combust and create heat to heat water passing through the heat exchanger 500. The air/fuel mixture can be introduced into the refractory 100 by the blower 200, ignited by the igniter assembly 300, and consumed in the burner assembly 400 to create heat. The resultant heat created by the combustion process can be directed through the refractory 100 and across the heat exchanger 500. The heat exchanger 500 can circulate water (or other fluids) through the path of the hot combustion gases to heat the water. As will be described in greater detail herein, the refractory 100 can be a single piece of heat resistant material configured to increase the overall thermal efficiency of the gas-fired water heating system. Furthermore, the location and position of the various components depicted in FIG. 1 can be arranged in different configurations to fit the particular application or hardware (e.g., blower 200, igniter assembly 300, burner assembly 400, heat exchanger 500).

The refractory 100, as shown in FIG. 1, can be configured such that the igniter assembly 300 and burner assembly 400 can be installed on a top side of the refractory 100 and the heat exchanger 500 can be installed on the bottom side of the refractory 100. Accordingly, the air/fuel mixture injected by the blower 200 can pass through the burner assembly 400 and into the refractory 100 from the top with the combustion gases exiting at the bottom. The refractory 100, however, is not limited to this configuration. As another example, the refractory 100 can be configured to have the igniter assembly 300 and burner assembly 400 installed on a side with the heat exchanger 500 installed on an opposite side such that the air/fuel mixture can pass through the refractory 100 from one side with the combustion gases exiting at the other side. Alternatively, the refractory 100 can be configured with the igniter assembly and burner assembly 400 installed on a bottom surface of the refractory 100 with the heat exchanger being installed on the top of the refractory such that the air/fuel mixture can pass through the refractory from the bottom and the combustion gases can exit at the top. As yet another example, the refractory 100 can be configured with the igniter assembly 300 and burner assembly 400 installed on the top of the refractory with the heat exchanger 500 installed on a side of the burner assembly and be configured such that the air/fuel mixture enters through the top of the refractory 100 and the combustion gases exit at the side of the refractory 100. As one of skill will appreciate, the actual configuration of the refractory 100 can be arranged to best fit the particular application.

The components depicted in FIG. 1 can also be configured in many different ways. For example, the igniter assembly 300 and burner assembly 400 can be a single unit rather than two separate units. As another example, the blower 200, igniter assembly 300, and burner assembly 400 can also be a single unit rather than three separate units. Alternatively, additional components (e.g., temperature sensors, flow sensors, flue gases sensor, valves, etc.) can be added depending on the particular application. As one of skill in the art will appreciate, the individual components can vary to best fit the particular application.

The refractory 100 can be made from a single piece of heat- and/or chemical-resistant material. The refractory 100 can be made from either clay or nonclay materials including fireclay, kaolin, bentonite, ball clay, common clay, aluminum silicate, aluminum oxide, silicon oxide, silicon carbide, magnesium oxide, calcium oxide, zirconia, mullite, dolomite, silicon carbide, graphite, tungsten carbide, boron nitrate, hafnium carbide, or any other suitable material that is capable of withstanding the heat and pressure as well as the corrosive environment created by the combustion process. By using heat- and chemical-resistant material, similar to those just described, the refractory 100 can also provide a thermal and chemical insulating layer between the hot combustion gases and the surrounding materials or environment. Additionally, the refractory 100 can be formed using manufacturing processes such as dry press, fused cast, molded, vacuum cast or any other suitable manufacturing process capable of making a single-piece refractory 100.

FIGS. 2A-FIG. 4 depict an example of the refractory 100. Although FIGS. 2A-FIG. 4 depict a specific example of the refractory 100, one of skill in the art will appreciate that the refractory 100 can be modified to accommodate various applications. For illustrative purposes, various aspects of the example refractory 100 are herein described but should not be construed as limiting the scope of this disclosure.

Figure 2A:
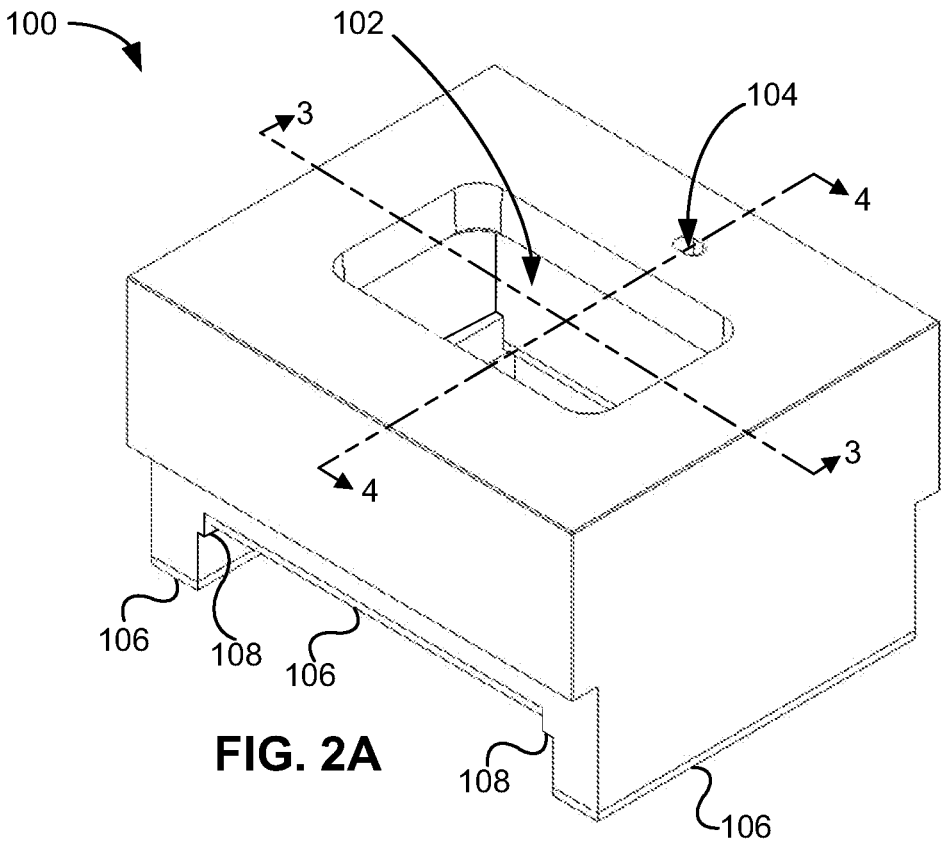
FIG. 2A illustrates a top isometric view of an example refractory, in accordance with the disclosed technology.
Figure 2B:
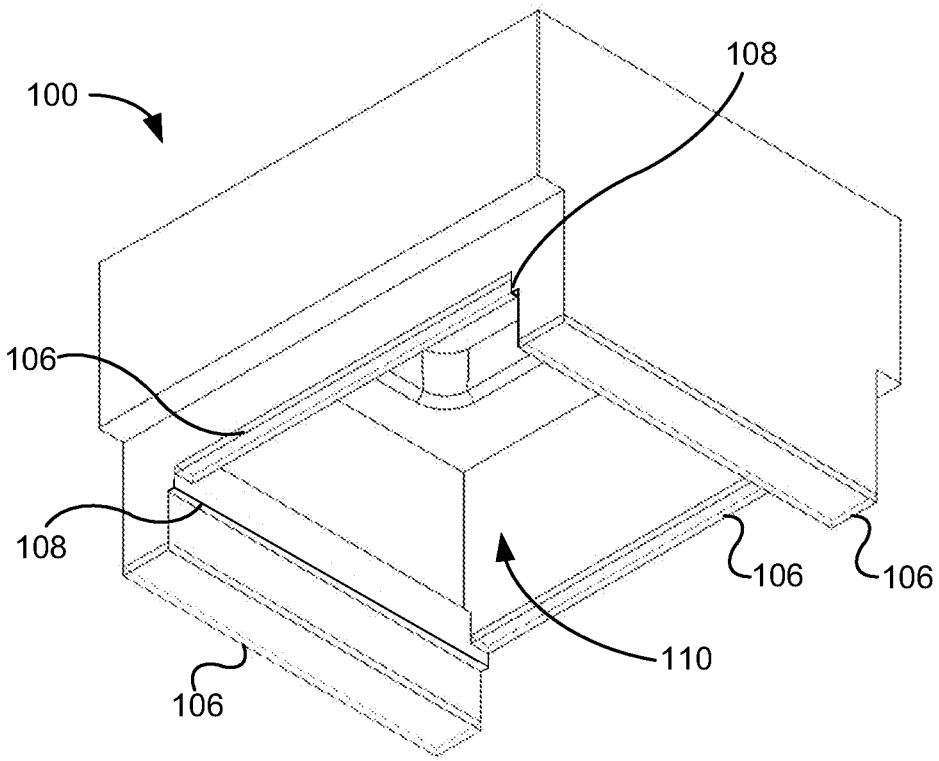
FIG. 2B illustrates a bottom isometric view of an example refractory, in accordance with the disclosed technology.

FIG. 2A and FIG. 2B are isometric views of a refractory 100 comprising a single piece of heat and chemical resistant material. FIG. 2A is a top isometric view while FIG. 2B is a bottom isometric view of the refractory 100. As shown, the refractory 100 can include a burner aperture 102, an igniter aperture 104, a sealing material 106, and a protrusion 108 on an inside surface of the refractory 100. The refractory 100 can comprise a substantially cuboid shape (as depicted in FIG. 2A and FIG. 2B) having a top, four sides, and no bottom. In the example show in FIGS. 2A-FIG. 4, the refractory 100 can have two sides which are longer (e.g., having a greater height) than the other two sides. In this configuration, the refractory 100 is configured to receive a heat exchanger 500 and form a seal between the refractory 100 and the heat exchanger 500.

Although depicted as a substantially cuboid shape, the refractory 100 can also be configured to comprise different shapes. The refractory 100, for example, can be a substantially rectangular prism shape, a substantially spherical shape, a substantially polyhedral shape, a substantially cylindrical shape, an irregular shape, or any other suitable shape for the application. One of skill in the art will appreciate that the refractory 100 can comprise various shapes and still perform some or all of the function provided by the example refractory 100 (e.g., include a burner aperture 102, an igniter aperture 104, a sealing material 106, and/or a protrusion 108).

The refractory 100 can form a cavity 110. The cavity 110 can be located between the burner 400 and the heat exchanger 500 when the burner 400 and the heat exchanger 500 are installed. Thus, the cavity 110 can function as a combustion chamber when the burner 400 consumes air and fuel to create heat to heat water passing through the heat exchanger 500. The cavity 110 can be sized and shaped to allow an air/fuel mixture injected into the burner 400 to be consumed inside of the cavity 110 such that the resultant combustion gases have room to expand and are directed through the heat exchanger 500. The cavity 110, for example, can be a substantially spherical shape, a substantially polyhedral shape, a substantially cylindrical shape, a substantially cuboid shape, an irregular shape, or any other suitable shape for the application. The cavity 110 can also be larger for applications where a large amount of heated water is needed (e.g., industrial applications) or smaller for applications where a smaller amount of heated water is needed (e.g., for residential applications).

Figure 3A:
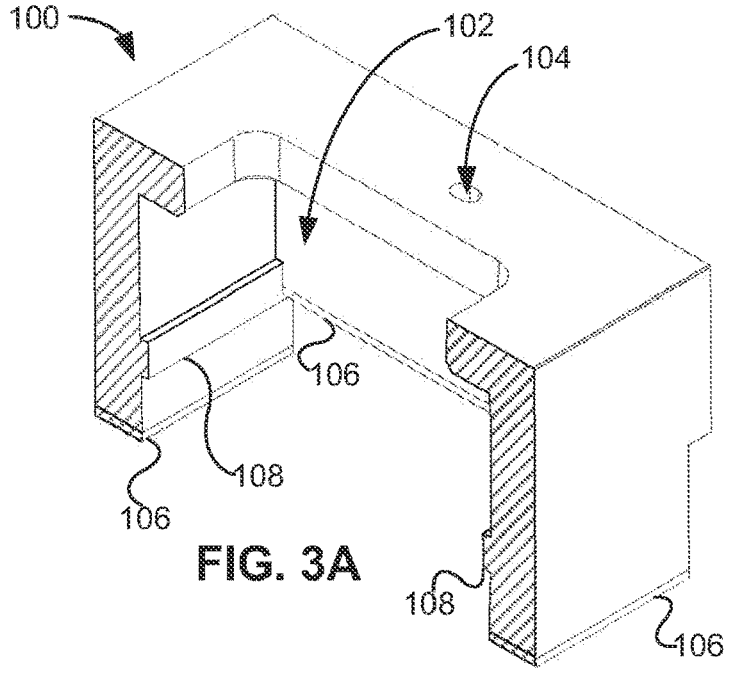
FIG. 3A illustrates a top isometric cross-sectional view of the example refractory shown in FIG. 2A taken along line 3-3, in accordance with the disclosed technology.
Figure 3B:
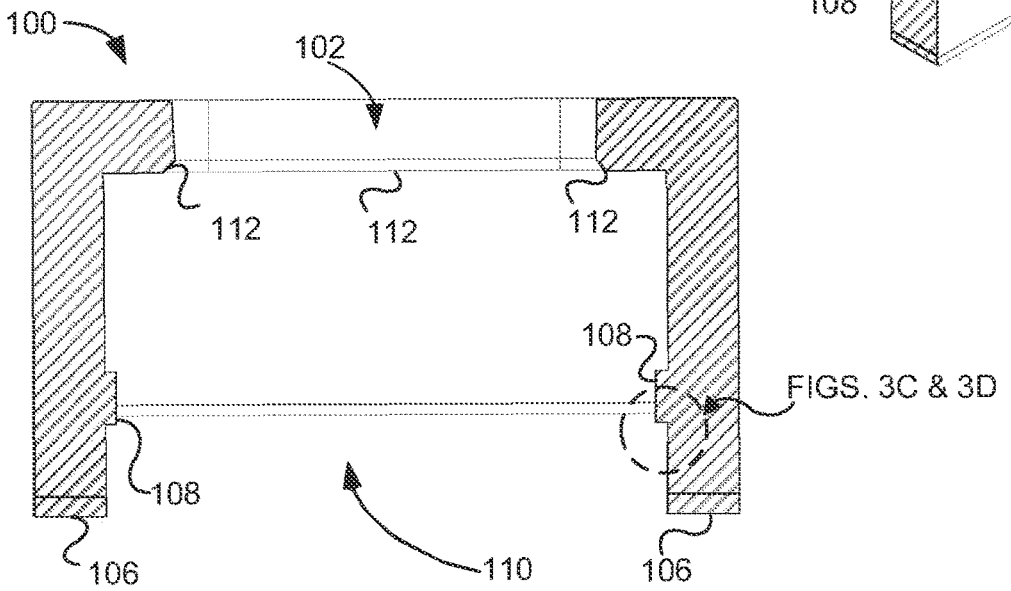
FIG. 3B illustrates a plan cross-sectional view of the example refractory shown in FIG. 2A taken along line 3-3, in accordance with the disclosed technology.
Figure 3C:
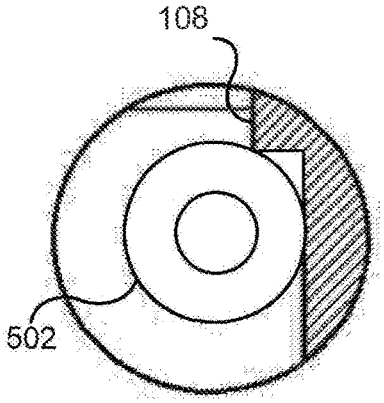
FIGS. 3C and 3D illustrate detailed section views of the example refractory shown in FIG. 3B, in accordance with the disclosed technology.

The refractory 100 can include a burner aperture 102 sized to receive a burner assembly 400 configured to burn an air/fuel mix injected into the burner assembly 400 by the blower 200. The burner aperture 102, can be any size or shape suitable for the application. The burner aperture 102, for example, can be substantially round, substantially rectangular, substantially triangular, an irregular shape, or any other shape suitable for the application. Furthermore, as can be seen in FIG. 3A and FIG. 3B, the burner aperture 102 can have a varying shape between the outer surface and the inner surface of the refractory 100. The varying shape, for example, can have a first area at the outer surface of the refractory 100 that is different than a second area 112 at the inner surface of the refractory 100.

As shown most clearly in FIG. 3B, the burner aperture 102 can have a top opening at the outer surface of the refractory 100 that is sized to receive a burner assembly 400 while the bottom opening 112 at the inner surface can be enlarged. The enlarged area at the bottom opening 112 can provide the burner assembly 400 with greater clearance nearest the burner outlet to allow the air/fuel mixture to flow into the cavity 110 without obstruction. The enlarged area at the bottom opening 112 can also provide additional room for the combustion gases to expand when the air/fuel mixture is consumed at the burner assembly 400. The bottom opening 112 can be angled, as depicted in FIG. 3B, or sloped or rounded. The burner aperture 102 can also have a varying shape between the outer surface and the inner surface of the refractory 100 that is configured to help secure the burner assembly 400 when the burner assembly 400 is installed while still providing the additional benefit of ensuring flow of the air/fuel mixture is not obstructed. For example, the burner aperture 102 can have recessed pockets or slots designed to help hold the burner assembly 400 in place when it is inserted into the burner aperture 102 while additionally having an enlarged bottom opening 112.

Figure 4:
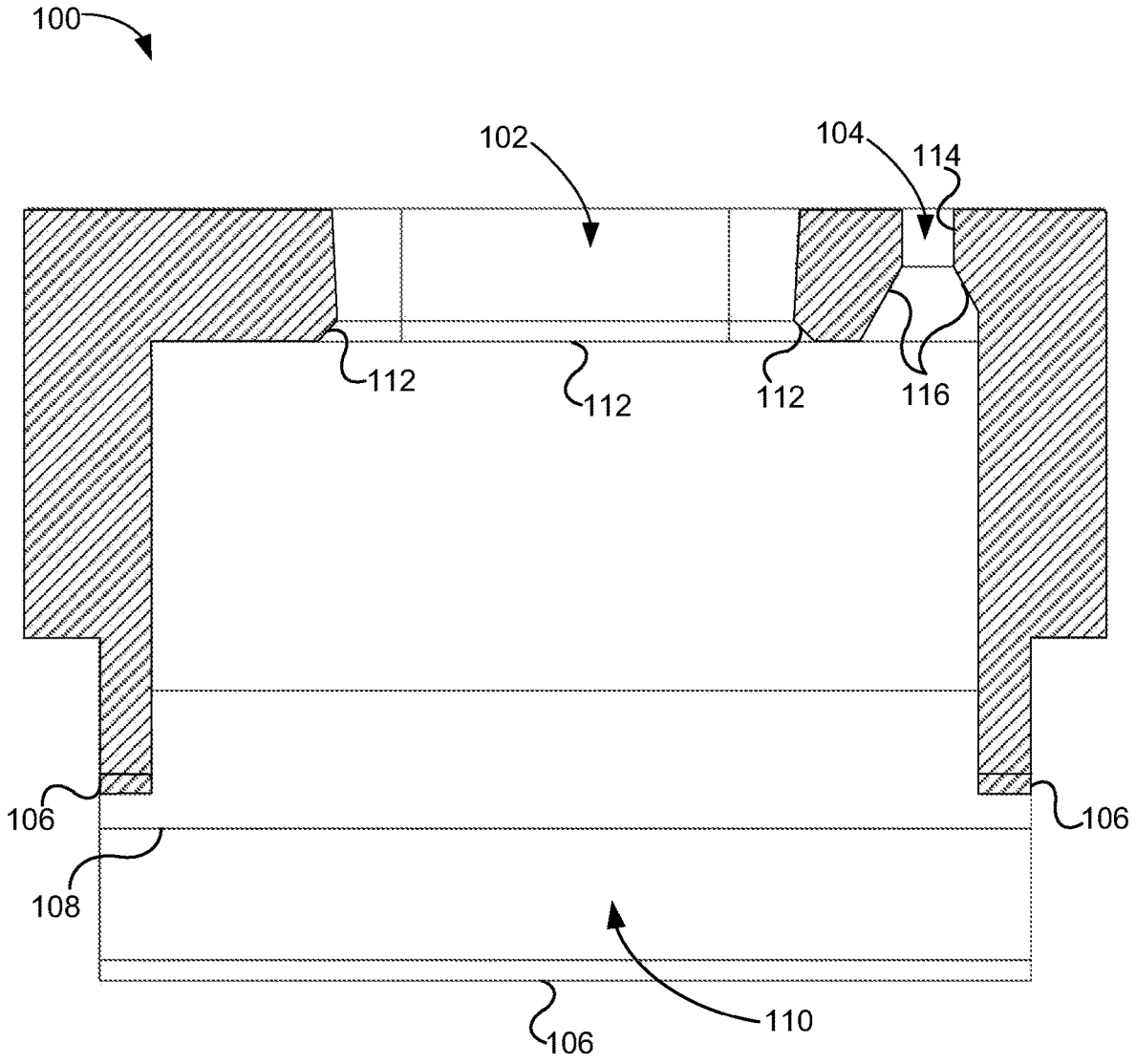
FIG. 4 illustrates a plan cross-sectional view of the example refractory shown in FIG. 2A taken along line 4-4, in accordance with the disclosed technology.

The refractory 100 can include an igniter aperture 104 sized to receive an igniter assembly 300 that is configured to ignite an air/fuel mixture injected into the burner 400. Similar to the burner aperture 102, and as depicted in FIG. 4, the igniter aperture 104 can have a varying shape between the outer surface and the inner surface of the refractory 100. The igniter aperture 104 can include two or more portions. The igniter aperture 104, for example, can have a substantially cylindrical shape 114 nearest the outer surface of the refractory 100 and a substantially frustoconical shape 116 nearest the inner surface of the refractory. Stated otherwise, the igniter aperture 104 can include a first portion having a generally cylindrical shape and a second portion that has a generally frustoconical shape. The first portion can be proximate the outer surface of the refractory 100, and the second portion can be proximate the inside surface of the refractory 100. In this configuration, the distance between the igniter assembly and the surface of the refractory 100 is greatest nearest the end of the igniter which can decrease the likelihood that a charge (or spark) of the igniter assembly 300 will find a path to ground through the refractory 100 rather than properly creating a spark. That is, the geometry of the igniter aperture 104 can help prevent misfires by the igniter assembly 300.

The shape of the igniter aperture 104 as depicted in FIG. 4 and just described is offered merely for illustrative purposes. Indeed, the igniter aperture 104 can have a different shape or configuration to best fit a particular application. For example, the igniter aperture 104 can have a substantially cuboid shape nearest the outer surface of the refractory 100 and a substantially pyramidal shape nearest the inner surface of the refractory 100. As another example, the igniter aperture 104 can have a frustoconical or frustopyramidal shape from the outer surface to the inner surface of the refractory 100 with the largest end being nearest the inside surface of the refractory 100. The frustoconical or frustopyramidal shape may change contour (e.g., change the pitch or angle) from the outer surface to the inner surface to accommodate the igniter assembly 300 and provide greater clearance nearest the inner surface of the refractory 100. As yet another example, the igniter aperture 104 can have a rounded or sloped contour between the outer surface and the inner surface of the refractory 100. As will be appreciated, the actual shape of the igniter aperture 104 can be varied to suit the particular application and provide the igniter assembly 300 with the appropriate clearance so that a charge or spark of the igniter assembly 300 is unlikely to ground out to the refractory 100.

The refractory 100 can include a sealing material 106 affixed to a surface of the refractory, and the sealing material can be configured to create a seal between the refractory 100 and the heat exchanger 500 when installed. The sealing material 106, for example, can be installed on a bottom surface of the refractory 100 and configured to seal the interface between the refractory 100 and the heat exchanger 500. The sealing material 106 can be attached to some or all of the bottom surface of the refractory (e.g., the bottom of some or all sidewalls of the refractory 100). The sealing material 106 can help increase the thermal efficiency of the water heating system by helping to prevent the air/fuel mixture and the combustion gases from escaping the combustion chamber. By preventing leakage of the air/fuel mixture and the combustion gases, the sealing material 106 can help to ensure heat created by the combustion process is directed through the heat exchanger 500 and used to heat the water.

The sealing material 106 can be or include any form of sealing material capable of withstanding the heat, pressure, and corrosive environment created by the combustion gases. The sealing material 106, for example, can be or include polytetrafluoroethylene (PTFE), polyetheretherketone (PEEK), flourosilicone, silicone, ceramic fiber blanket, graphite laminate, graphite foil, Frenzelit Novatec, fiberglass tape (or rope), or any other suitable sealing material for the application. Because the sealing material 106 can deform under pressure, the sealing material 106 can ensure a tight seal is formed between the refractory 100 and the heat exchanger 500. The sealing material 106 can be affixed to the bottom surface of the refractory 100 or simply placed between the refractory 100 and the heat exchanger 500 when assembled to seal the interface between the refractory 100 and the heat exchanger 500. Alternatively, the sealing material 106 can be manufactured (e.g., molded) together with the rest of the refractory 100 when the refractory 100 is formed. Thus, the sealing material 106 can be a part of the refractory 100 itself.

The refractory 100, as can be seen in FIGS. 3A-3D, can include a protrusion 108 on an inside surface of the refractory 100 (i.e., in the cavity 110). The additional material added to the refractory 100 by including a protrusion 108 can provide additional structural support to the refractory 100. The protrusion 108, for example, can help prevent deflection of the sidewalls of the refractory 100 which could otherwise cause cracking and damage to the refractory 100. The protrusion 108 can also be configured to interface with the heat exchanger 500 and create a seal or a substantial seal between the refractory 100 and the heat exchanger 500. The protrusion 108, for example, can be configured to create a substantially airtight seal between the protrusion 108 and the heat exchanger 500. Alternatively, the protrusion 108 can create a seal that is less than airtight such that the protrusion 108 reduces, but does not eliminate altogether, the amount of combustion gases that pass through a gap between the protrusion 108 and the heat exchanger 500. In this way, the protrusion 108 can help increase the overall thermal efficiency of the system because the warm combustion gases are directed through the heat exchanger 500 rather than allowed to escape around the heat exchanger 500. As will be appreciated, as greater amounts of combustion gases are directed through the heat exchanger 500, the heat exchanger 500 will be able to transfer more heat from the combustion gases to the fluid within the heat exchanger 500. On the other hand, if greater amounts of combustion gases are allowed to escape around the heat exchanger 500, the heat exchanger 500 will be unable to transfer as much heat to the fluid within the heat exchanger 500.

Figure 3D:
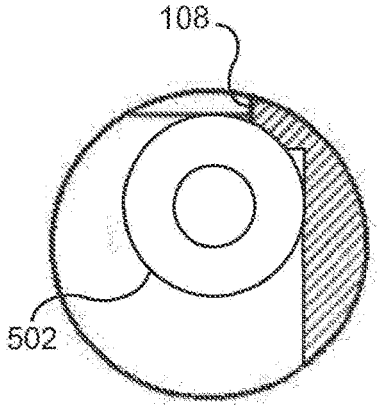

The protrusion 108 can have a substantially rectangular cross-section, as depicted in FIGS. 2A-FIG. 3D, or the protrusion 108 can have a trapezoidal, semi-circular, triangular, polygonal, or any other shaped cross-section. As one of skill in the art will appreciate, the shape of the protrusion 108 can be modified for the particular application to ensure the protrusion 108 is configured to interface with the heat exchanger. The protrusion 108 can be configured to abut the fins 502 of the heat exchanger 500 (as depicted in FIG. 3C) or the protrusion 108 can be configured to deform such that the fins 502 of the heat exchanger 500 cut into the protrusion 108 and reduce the area between the protrusion 108 and the heat exchanger 500 (as depicted in FIG. 3D). If the protrusion 108 is configured to deform when in contact with the fins 502 of the heat exchanger 500, the protrusion 108 can experience either elastic deformation or plastic deformation depending on the configuration and the material used to manufacture the refractory 100. While the protrusion 108 is shown in the figures as being located on certain walls (e.g., on tall or long walls), any or all walls of the refractory 100 can include a protrusion 108.

As another example, the protrusion 108 can be configured to have sealing material affixed to a surface of the protrusion 108 to create the seal. In this example, the sealing material can be the same as the sealing material 106 previously discussed or the sealing material can be a different type of sealing material than that already discussed. The sealing material can be made from a material that is less brittle than the material used to make the refractory 100. Using a sealing material on the protrusion that is less brittle than the material used to make the refractory 100 can help to ensure that elastic deformation, rather than plastic deformation, is more likely to occur when the fins 502 of the heat exchanger 500 cut into the protrusion 108. As one of skill in the art will appreciate, the protrusion 108 can comprise various arrangements configured to provide structural support to the refractory 100 and reduce the amount of combustion gases allowed to pass between the heat exchanger 500 and the wall of the refractory 100 as required for a particular application.

While the present disclosure has been described in connection with a plurality of exemplary aspects, as illustrated in the various figures and discussed above, it is understood that other similar aspects can be used, or modifications and additions can be made to the described aspects for performing the same function of the present disclosure without deviating therefrom. For example, in various aspects of the disclosure, methods and compositions were described according to aspects of the presently disclosed subject matter. But other equivalent methods or composition to these described aspects are also contemplated by the teachings herein. Therefore, the present disclosure should not be limited to any single aspect, but rather construed in breadth and scope in accordance with the appended claims.

What is claimed is:

1. A water heater system comprising:

a blower configured to move a mixture of air and fuel;

an igniter configured to ignite the mixture of air and fuel;

a burner configured to produce a controlled flame created by igniting the mixture of air and fuel;

a heat exchanger configured to facilitate heat transfer from the controlled flame to a fluid flowing through the heat exchanger; and a refractory configured to attach to the burner and the heat exchanger and retain the heat as the heat is directed from the burner and toward the heat exchanger, wherein the refractory comprises:

a unitary ceramic housing comprising:

a refractory top having a burner aperture extending therethrough, the refractory top configured to receive at least a portion of the burner; and a plurality of sidewalls forming a central cavity of the ceramic housing, each of the plurality of sidewalls having a first end extending from the refractory top and a second end disposed proximate the heat exchanger, wherein a sidewall of the plurality of sidewalls comprises a protrusion extending laterally along an inside surface of the sidewall, the protrusion being configured to contact the heat exchanger and form a seal between the heat exchanger and the refractory by deforming when a plurality of fins of the heat exchanger contact the protrusion.

2. The system of claim 1, wherein the protrusion of the refractory is configured to deform such that, when the refractory is installed, a plurality of fins of the heat exchanger cut into the protrusion to form the seal.

3. The system of claim 1, wherein a single unit comprises the burner and the igniter.

4. The system of claim 1, wherein the refractory top further comprises an igniter aperture extending therethrough, the refractory top being configured to receive the igniter.

5. The system of claim 4, wherein:

the igniter aperture has an inner end and an outer end, the inner end being proximate an inner surface of the refractory top and the outer end being proximate an outer surface of the refractory top, and an area of the inner end is greater than an area of the outer end.

6. The system of claim 5, wherein the inner end of the igniter aperture comprises a substantially frustoconical shape.

7. The system of claim 1, wherein:

the burner aperture has an inner end and an outer end, the inner end being proximate an inner surface of the refractory top and the outer end being proximate an outer surface of the refractory top, and an area of the inner end is greater than an area of the outer end.

8. The system of claim 1, the plurality of sidewalls further comprising a sealing material affixed to a bottom surface of the plurality of sidewalls and configured to form a seal between the plurality of sidewalls and the heat exchanger.

9. The system of claim 1, wherein:

the protrusion is a first protrusion, the plurality of sidewalls comprises two short sidewalls and two long sidewalls, each of the two short sidewalls having a height that is less than a height of either of the long sidewalls, one of the two long sidewalls comprises the first protrusion and the other of the two long sidewalls comprises a second protrusion, and the two short sidewalls are configured to contact the heat exchanger.

10. A unitary housing for a water heating assembly, the unitary housing comprising:

a top having a burner aperture extending therethrough, the top configured to receive at least a portion of a burner; and a plurality of sidewalls forming a central cavity of the unitary housing, each of the plurality of sidewalls having a first end extending from the top and a second end configured to contact a heat exchanger, wherein one or more of the plurality of sidewalls comprises a protrusion extending laterally along an inside surface of one of the plurality of sidewalls, the protrusion being configured to deform upon contact with a plurality of fins of the heat exchanger to create a seal between the heat exchanger and the unitary housing, and wherein the unitary housing is configured to retain heat produced by the burner.

11. The unitary housing of claim 10, further comprising an igniter aperture extending through the top, the igniter aperture being configured to receive an igniter.

12. The unitary housing of claim 11, wherein the igniter aperture has an inner end and an outer end, the inner end being proximate an inner surface of the top and the outer end being proximate an outer surface of the top, and wherein an area of the inner end is greater than an area of the outer end.

13. The unitary housing of claim 12, the igniter aperture comprising a substantially frustoconical shape.

14. The unitary housing of claim 10, wherein the burner aperture has an inner end and an outer end, the inner end being proximate an inner surface of the top and the outer end being proximate an outer surface of the top, and wherein an area of the inner end is greater than an area of the outer end.

15. The unitary housing of claim 10, wherein the protrusion is configured to deform such that a plurality of fins of the heat exchanger cut into the protrusion to form the seal.

16. The unitary housing of claim 10 fill further comprising a sealing material located on a surface of the protrusion, the sealing material being configured to form the seal between the heat exchanger and the unitary housing.

17. The unitary housing of claim 10 further comprising a sealing material affixed to a bottom surface of at least one of the plurality of sidewalls, the sealing material being configured to form a seal between the plurality of sidewalls and the heat exchanger.

18. The unitary housing of claim 10, wherein:

the protrusion is a first protrusion, the plurality of sidewalls comprises two short sidewalls and two long sidewalls, each of the two short sidewalls having a height that is less than a height of either of the long sidewalls, one of the two long sidewalls comprises the first protrusion and the other of the two long sidewalls comprises a second protrusion, and the two short sidewalls are configured to contact the heat exchanger.

19. A water heater system comprising:

a blower configured to move a mixture of air and fuel;

an igniter configured to ignite the mixture of air and fuel;

a burner configured to produce a controlled flame created by igniting the mixture of air and fuel;

a heat exchanger configured to facilitate heat transfer from the controlled flame to a fluid flowing through the heat exchanger; and a refractory configured to attach to the burner and the heat exchanger and retain the heat as the heat is directed from the burner and toward the heat exchanger, wherein the refractory comprises:

a unitary ceramic housing comprising:

a refractory top having a burner aperture extending therethrough configured to receive at least a portion of the burner, and an igniter aperture extending therethrough configured to receive the igniter; and a plurality of sidewalls forming a central cavity of the ceramic housing, each of the plurality of sidewalls having a first end extending from the refractory top and a second end disposed proximate the heat exchanger, wherein a sidewall of the plurality of sidewalls comprises a protrusion extending laterally along an inside surface of the sidewall, the protrusion being configured to contact the heat exchanger.

20. The system of claim 19, wherein:

the igniter aperture has an inner end and an outer end, the inner end being proximate an inner surface of the refractory top and the outer end being proximate an outer surface of the refractory top, and an area of the inner end is greater than an area of the outer end.

* * * * *